United States Patent [19]

Martinez, Sr.

[11] Patent Number: 4,489,971

[45] Date of Patent: Dec. 25, 1984

[54] COLLAPSIBLE PENSILE FOOD CARRIER

[76] Inventor: Alfonso E. Martinez, Sr., 1019 Hickey Ave., Alice, Tex. 78332

[21] Appl. No.: 465,627

[22] Filed: Feb. 10, 1983

[51] Int. Cl.[3] ..... B65D 73/00

[52] U.S. Cl. ..... 294/143; 294/144; 294/172; 206/462

[58] Field of Search ..... 206/457, 462; 224/202; 294/143, 144, 172; D3/42

[56] References Cited

U.S. PATENT DOCUMENTS 3,164,257 1/1965 Foy ..... 294/143

4,140,164 2/1979 Staup ..... D3/42

*Primary Examiner*—Stephen Marcus

*Assistant Examiner*—David Voorhees

*Attorney, Agent, or Firm*—Gerald G. Crutsinger; John F. Booth; Monty L. Ross

[57] ABSTRACT

A collapsible pensile food carrier is provided that comprises slidably engaged beverage support members adapted to receive and transport a plurality of drinking cups and having a foldable auxiliary food transport pouch suspended therefrom. A kit comprising the subject collapsible pensile food carrier in combination with a storage pouch is also provided.

4 Claims, 10 Drawing Figures

COLLAPSIBLE PENSILE FOOD CARRIER

TECHNICAL FIELD

This invention relates to apparatus for use in transporting food products by hand. One aspect of the invention relates to collapsible apparatus that enables an individual to manually support and transport more food products than could otherwise be carried in his hands. Another aspect of the invention relates to a kit comprising the collapsible food carrier of the invention in combination with a pouch for storing the collapsed food carrier when not in use.

BACKGROUND OF THE INVENTION

Spectators at sporting events, concerts, circuses and the like are well familiar with problems encountered in transporting food products purchased at concession stands back to their seats or to some other place where the food products are to be consumed. In many instances it is difficult or impossible for purchasers to carry food products back to their seats in their hands, particularly when one person purchases food products for others besides himself. Although carrying trays are sometimes provided by concessionaires, such trays are many times unsatisfactory for supporting and transporting food products, especially beverages, without risk of spillage.

Where spillage occurs, the person transporting the food products, or other persons seated or walking nearby, or both, may be subjected to serious injury from burns, slipping and falling, or the like. Moreover, even where such disposable trays are provided and utilized, they are typically discarded by the spectator/purchaser after use, thereby contributing to the litter and debris that must be cleaned up following such an event.

Accordingly, there exists a need for an apparatus adapted to permit a single user to manually transport a plurality of food products conveniently and with low risk of spillage. Such food products can include, for example, hamburgers, hot dogs, sandwiches, corn dogs, nachos, burritos, chips, pipcorn, candies, chewing gum, cake, pies, cookies, and any other food products, intended for consumption by an individual or small group at or near the place of purchase. As used herein, it is understood that the term "food products" also includes drinks such as carbonated beverages, juices, milk, tea, coffee and the like that are customarily served in disposable cups or other containers at sporting events, concerts, or other large public gatherings.

Furthermore, an apparatus for use in supporting and transporting such food products should desirably be reusable, and should be adaptable for storage within a compact space when not in use.

SUMMARY OF THE INVENTION

According to the present invention, apparatus is provided that permits an individual to manually support and transport more food products than he could otherwise carry in his hands.

According to a primary object of the invention, a collapsible pensile food carrier is provided that comprises two rigid, slidably engaged members adapted to support and transport one or more beverages, and a substantially flexible receptacle suspended therefrom that is adapted to support and transport additional food products.

Another object of the invention is to provide a collapsible carrier for food products that embodies simple, well-balanced construction, and that can be readily and economically fabricated and assembled on a mass production basis.

Another object of the invention is to provide a reusable pensile food carrier that is attractive, sturdy, durable and can be readily stored when not in use.

According to yet another object of the invention, apparatus is provided that permits the user to manually transport a plurality of food products with significantly reduced risk of droppage or spillage, or other accidents or injuries attendant thereto.

Yet another object of the invention is to provide a kit comprising a collapsible food carrier together with a convenient means for carrying and storing the food carrier when it is not in use.

These and other objects and improvements of the present invention are further described in the detailed description set forth below.

BRIEF DESCRIPTION OF THE DRAWINGS

The invention is further explained in relation to the accompanying drawings wherein.

Like numerals are used to designate like parts in the various figures of the drawings.

DESCRIPTION OF A PREFERRED EMBODIMENT

Figure 1:
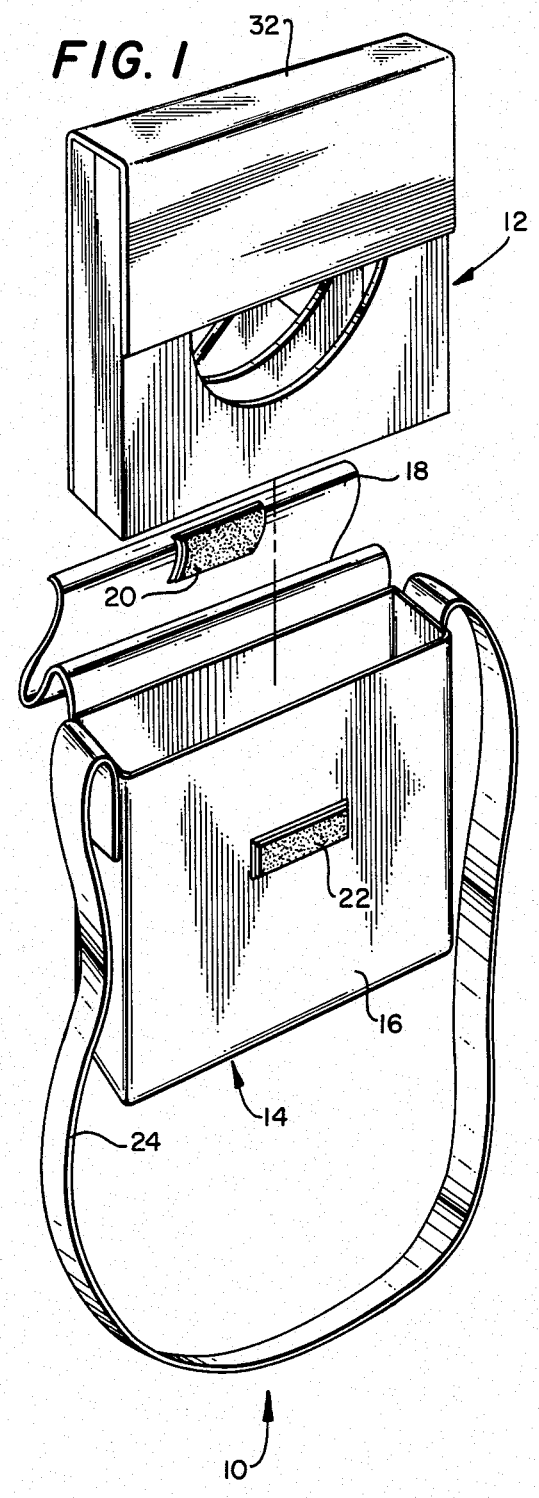
FIG. 1 is a simplified perspective view depicting a preferred embodiment of the kit of the invention.

Referring to FIG. 1, kit 10 of the invention preferably comprises collapsible pensile food carrier 12 and storage pouch 14. Storage pouch 14 further comprises storage receptacle 16 that is adapted to receive and store collapsible pensile food carrier 12 when not in use. The material from which storage receptacle 16 is constructed can be either flexible or rigid, and is preferably made of cloth, vinyl, leather, or any other similarly effective material. Storage pouch 14 is preferably further adapted by means of cover 18 to maintain and protect collapsible pensile food carrier 12 within storage receptacle 16. Cover 18 is preferably flexible so as to facilitate closure over the open end of storage receptacle 16. Storage pouch 14 is preferably further adapted by closure means 20, 22 connected to cover 18 and storage receptacle 16, respectively, to maintain cover 18 in a closed position over storage receptacle 16 after collapsible pensile food carrier 12 is inserted therein.

As shown in FIG. 1, preferred closing means 20, 22 for use with the present invention are velcro strips, although it is understood that other similarly effective means can also be used within the scope of the invention. Thus, buttons, latches, snaps, hooks, zippers, or the like can be substituted if desired.

Storage pouch 14 is further adapted by means of strap 24 to be conveniently carried by the user. Strap 24 can be attached to storage receptacle 16 of storage pouch 14 by a conventional method such as, for example, sewing, riveting or the like. The length of strap 24 can be such that storage pouch 14 may be carried in the hand or worn over the neck or shoulder, as desired. Also, strap 24 can be further adapted by buckles or other adjusting means so that its effective length can be varied or controlled by the user. According to another embodiment of the invention that is not shown in the drawings, storage pouch 14 can be further adapted by means of slits positioned in the back side of storage receptacle 16 or loops attached thereto to be worn on the belt of the user in the same manner as a scabbard or holster. Likewise, other means such as clips, snap rings or the like can also be employed for attaching storage pouch 14 to the person or clothing of the user.

Storage pouch 14 can be further adapted by attaching to its means such as initials, logos, or the like, for identifying it with the user, or with a particular sponsor, or with an athletic team, if desired.

Figure 2:
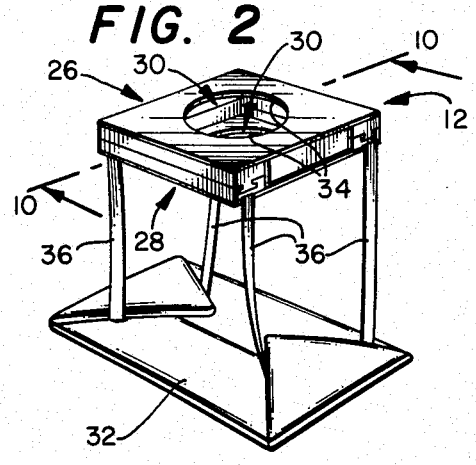
FIG. 2 is a simplified perspective view depicting a preferred embodiment of the collapsible pensile food carrier of the invention in a partially expanded position.

FIG. 2 is a perspective view depicting collapsible pensile food carrier 12 of the invention after it has been removed from storage pouch 14 as shown in FIG. 1 and partially expanded. Referring to FIG. 2, collapsible pensile food carrier 12 further comprises two slidably engaged beverage support members 26, 28, respectively, each having at least one aperture 30 extending therethrough for supporting and maintaining a conventionally sized drinking cup in an upright position while being transported by the user. Beverage support members 26, 28 are preferably constructed from a substantially rigid material. By use of the term "substantially rigid", it is intended that beverage support members 26, 28 not be readily deformable under the conditions of expected use. Thus, for example, beverage support member 26 is desirably rigid enough that a conventional drinking cup can be received through and supported by loop 34 around aperture 30 without deforming sufficiently for the cup to fall through. Preferred materials for use as beverage support members 26, 28 include, for example, extrudable or moldable thermoplastic or thermosetting polymeric resins, or laminates thereof, fiber reinforced thermosetting resins, wood, wood products, or the like.

Figure 3:
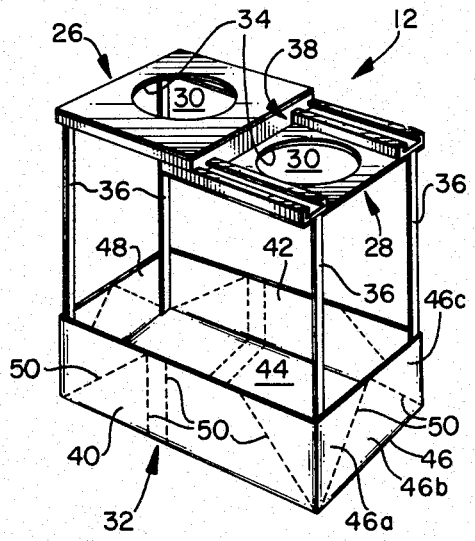
FIG. 3 is a simplified perspective view depicting a preferred embodiment of the collapsible pensile food carrier of the invention in its fully expanded position.

As shown in FIG. 2, collapsible pensile food carrier 12 preferably further comprises an auxiliary receptacle 32 suspended by straps 36 by beverage support members 26, 28. Auxiliary receptacle 32 and straps 36 can be made of the same or similar material, and are preferably strong enough to support a load of several pounds without noticeable deformation. Referring again to FIG. 1, auxiliary receptacle 32 and straps 36 (not shown) are preferably adapted to be folded around collapsed beverage support members 26, 28 so as to permit easy insertion of collapsible pensile food carrier 12 into storage pouch 14. Auxiliary receptacle 32 and straps 36 are further described in relation to FIG. 3, in which collapsible pensile food carrier 12 is shown in its fully expanded position. Referring to FIG. 3, beverage support members 26, 28 are slidably expanded to the point that aperture 30 in beverage support member 28 is no longer obscured by beverage support member 26. Slide stop 38 of beverage support member 26 cooperates with a similar slide stop on beverage support member 28 (not visible in FIG. 3) to prevent beverage support members 26, 28 from slidably disengaging when fully expanded. Auxiliary receptacle 32 preferably further comprises front wall 40, back wall 42, bottom 44 and end walls 46, 48, respectively. Although the means for attaching straps 36 to auxiliary receptacle 32 and beverage support members 26, 28, respectively, are not shown in FIG. 3, it will be appreciated by those of ordinary skill in the art that there are many such conventional means which can be successfully employed. Thus, for example, straps 36 might be sewn or riveted to auxiliary receptacle 32 and either riveted to or molded into beverage support members 26, 28.

The walls and bottom of auxiliary receptacle 32 may be constructed from the same material as storage pouch 14, or from a different material, as desired. According to a preferred embodiment of the invention, front wall 40, back wall 42, bottom 44 and end walls 46, 48 of auxiliary receptacle 32 each comprise a plurality of smaller, substantially rigid panels separated by creases 50. When constructed in this manner, some rigidity is provided to the walls and bottom of auxiliary receptacle 32 while still permitting the receptacle to be collapsed and folded around beverage support members 26, 28 for insertion into storage pouch 14. Thus, for example, end wall 46 might preferably be constructed by laminating three substantially rigid triangular panels 46*a*, 46*b*, 46*c* between two coextensive rectangular sheets of cloth, vinyl, or the like, and thereafter stitching or heat sealing said sheets together around the perimeter of end wall 46 and around the perimeter of each of panels 46*a*, 46*b*, 46*c*, thereby providing some rigidity to end wall 46, but also permitting it to be collapsed and folded along creases 50 to facilitate storage.

According to another embodiment of the invention, auxiliary receptacle 32 can be provided with a relatively stiff bottom liner having a single crease that will permit it to be folded over and thereby collapsed into an area not greater than that of one storage support member to facilitate storage. According to yet another ambodiment of the invention, the interior portion of auxiliary receptacle 32 can be further partitioned into a pluraity of smaller compartments, if desired.

Figure 6:
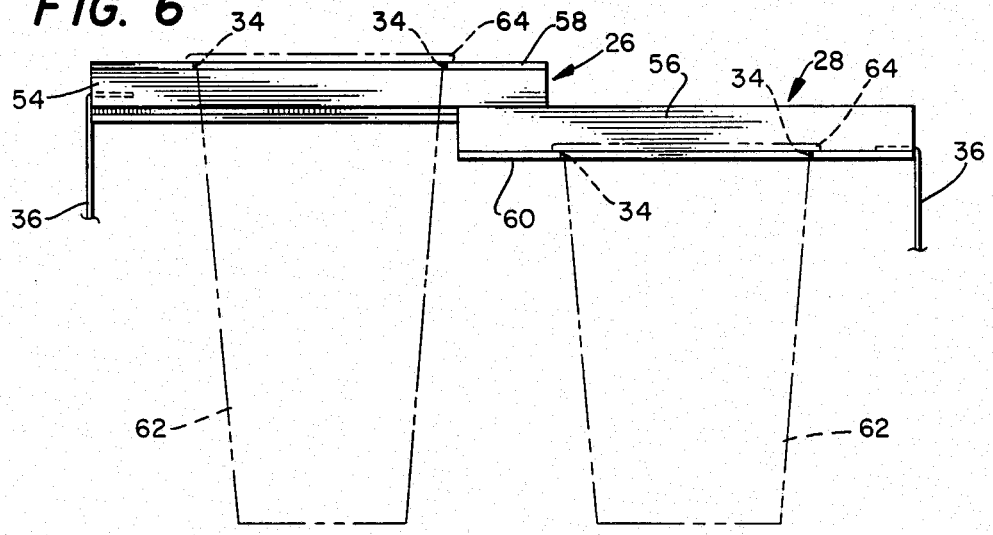
FIG. 6 is a front elevation view of the beverage support means of FIG. 4, shown in its fully expanded position and supporting two beverage cups (shown in phantom)

Beverage support members 26, 28 of collapsible pensile food carrier 12 are further described and explained in relation to FIGS. 4–10. At the outset, although beverage support members 26, 28 each comprise a single aperture 30 as shown in the drawings, it is to be understood that the apparatus of the invention is similarly adaptable to a configuration for transporting four, six, eight or even more beverages in a single carrier. Thus, rather than comprising one centrally disposed aperture 30 for receiving a single beverage cup as shown in the drawings, beverage support member 26 can include, for example, four separate, spaced apart apertures, each of which is adapted to receive and support a beverage cup.

Where beverage support members 26, 28 comprising a plurality of apertures 30 are utilized, the diameters of apertures 30 can be varied to accommodate cups of various sizes. Generally speaking, it is believed that the vast majority of drinking cups supplied by the concessionaires at sporting events, concerts and other large public gatherings can accommodate between about six and about twenty-four fluid ounces of beverage. According to a most preferred embodiment of the invention, apertures 30 through beverage support members 26, 28 will each have a diameter that is somewhat smaller than the largest diameter of the smallest cup likely to be encountered and somewhat larger than the smallest diameter of the largest cup likely to be encountered by the user. Because the side walls of drinking cups are typically tapered as shown in FIG. 6 (to facilitate stacking prior to use), this criteria should permit collapsible pensile food carrier 12 to be used with most beverage cups that are likely to be encountered. However, in accordance with another embodiment of the invention, each beverage support member 26, 28 can be provided with two relatively larger apertures and two relatively smaller apertures to accommodate different size cups.

Figure 4:
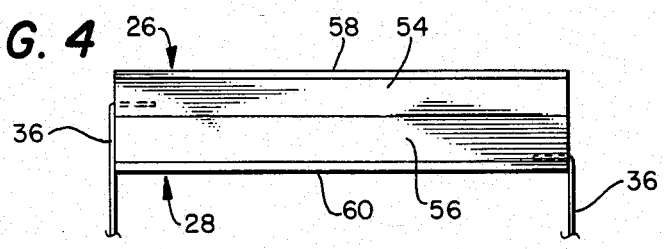
FIG. 4 is a front elevation view depicting a preferred embodiment of the beverage support member of the subject pensile food carrier in its collapsed position.

FIG. 4 is a simplified front elevation view depicting beverage support members 26, 28 in their fully collapsed positions. As shown in FIG. 4, the uppermost portions of straps 36 are actually embedded or molded into the material comprising beverage support members 26, 28, as is possible if such members are molded from either a thermal plastic or thermosetting polymeric resin. Alternatively, it is understood that straps 36 can also be operably connected to beverage support members 26, 28 by other means such as rivets, screws, nails, adhesives, or the like.

Figure 5:
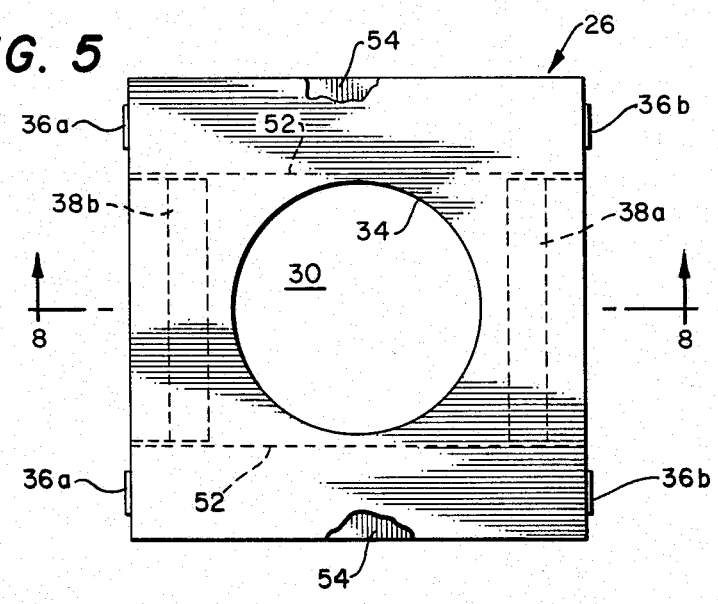
FIG. 5 is a plan view of the beverage support means shown in FIG. 4, also in the collapsed position.

FIG. 5 depicts a plan view of beverage support member 26 when disposed over beverage support member 28 in the collapsed position. As shown in FIG. 5, apertures 30 and lips 34 of beverage support members 26, 28 are coextensive. Straps **36*a* are embedded in or otherwise connected to beverage support member 26 as shown in FIG. 4, and straps 36*b* are embedded in or otherwise connected to beverage support member 28 as shown in FIG. 4. The outlines of slide blocks 38*a* connected to beverage support member 26 and 38*b* connected to beverage support member 28 are hidden beneath the upper surface of beverage support member 26, as shown by the dashed lines in FIG. 5. Dashed lines 52 depict the interior edges of upper and lower slide members 54, 56, respectively, as shown in FIG. 10**.

FIG. 6 is a front elevation view depicting beverage support members 26, 28 of FIG. 4 in their fully expanded position, and having beverage cups disposed therein. According to a preferred embodiment of the invention as shown in FIGS. 6 and 10, beverage support member 26 further comprises two parallel and spaced apart elongated upper slide members 54 that are connected to an overlying horizontal sheet portion 58. Similarly, beverage support member 28 preferably comprises two parallel and spaced apart elongated lower slide members 56 that are connected to an underlying horizontal sheet portion 60. Horizontal sheet portions 58, 60 each preferably further comprise at least one substantially circular aperture defined by lip 34. As shown in FIG. 6, drinking cups 62 extend through apertures 30 with rims 64 of cups 62 having a diameter slightly greater than that of aperture 30 so that rims 64 are engaged and supported by lips 34. It is understood, of course, that larger diameter cups 62 can also be employed with the apparatus of the invention provided, however, that the sides of cups 62 are inwardly tapered toward the bottom portions thereof and that the maximum outside diameter of the lower half of the side walls of cups 62 is less than the diameter of apertures 30. Desirably, at least about half of cups 62 should extend downward through apertures 30 to reduce the likelihood of tipping or spilling during transport.

Figure 7:
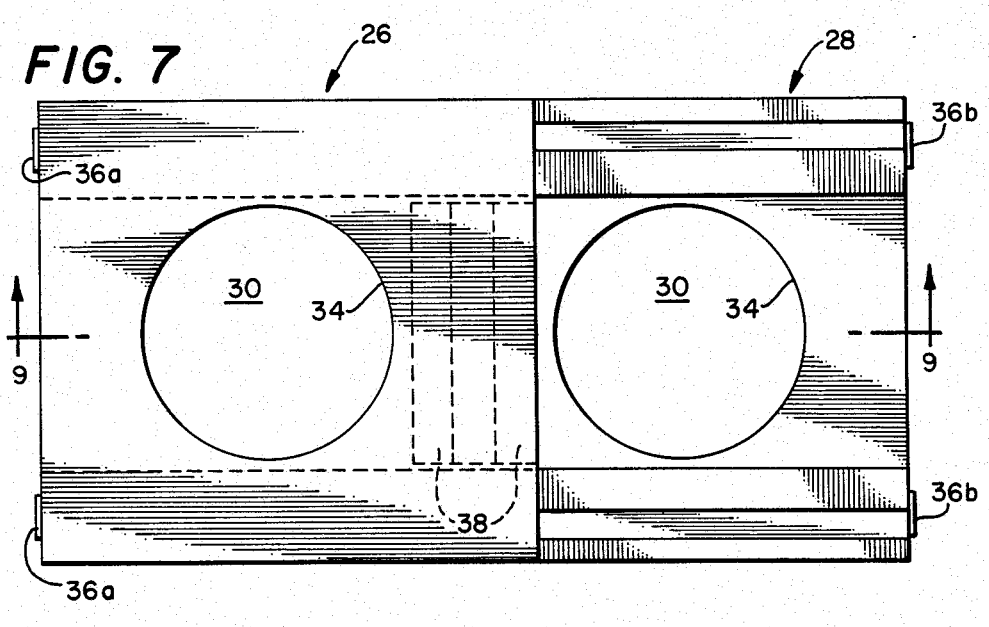
FIG. 7 is a plan view showing the beverage support means of FIG. 5 in its fully expanded position.

FIG. 7 is a plan view depicting beverage support members 26, 28 in their fully expanded positions. Locking engagement between beverage support members 26, 28 is provided by slide blocks 38, which prevent upper and lower slide members 54, 56 from slidably disengaging as beverage support members 26, 28 are expanded.

Figure 8:
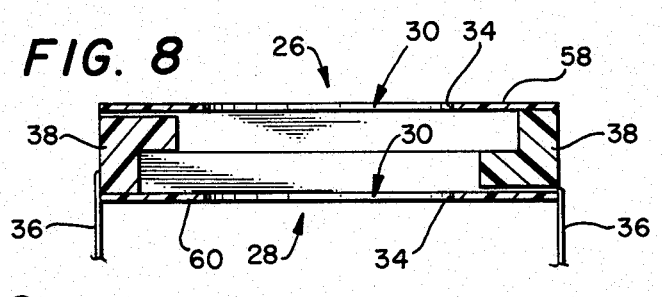
FIG. 8 is a sectional elevation view taken along line 8—8 of FIG. 5.
Figure 9:
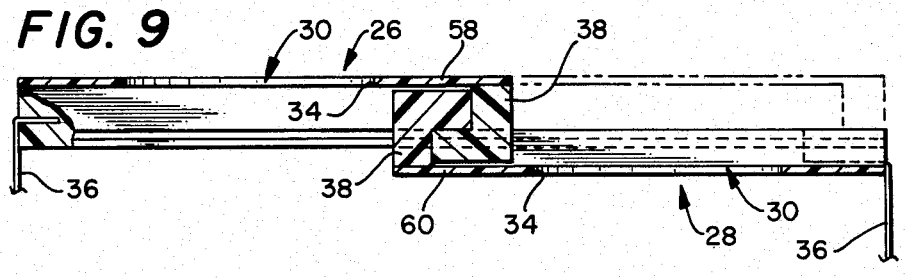
FIG. 9 is a sectional elevation view, partially broken away, taken along line 9—9 of FIG. 7.
Figure 10:
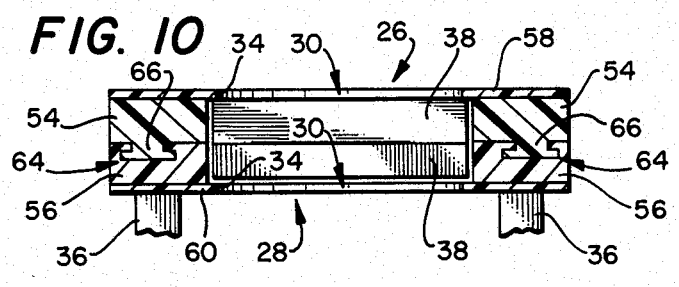
FIG. 10 is a sectional side elevation view of the beverage support means of the collapsible pensile food carrier of the invention as viewed along line 10—10 of FIG. 2.

The manner in which slide blocks 38 and upper and lower slide members 54, 56 function so as to permit beverage support members 26, 28 to be expanded and collapsed is further described in relation to FIGS 8–10. First referring to FIG. 10, each lower slide member 56 preferably further comprises a T-shaped channel 64 adapted to slidably engage T-shaped lugs 66 of upper slide members 54. Slide blocks 38 are preferably adapted to engage as shown in FIG. 9 when beverage support members 26, 28 are expanded. Slide blocks 38 can be further adapted to permit beverage support members 26, 28 to be locked in the expanded position during use and then unlocked for subsequent collapsing and storage.

Although the lug and groove arrangement shown in FIG. 10 is a preferred configuration for use in the apparatus of the invention, it is understood of course that other configurations and means providing sliding engagement between beverage support members 26, 28 are similarly useful within the scope of the invention. Upper and lower slide members 54, 56 as shown in FIG. 10 can be integrally molded together with horizontal portions 58, 60, respectively, or can be separately manufactured and thereafter bonded or otherwise connected to the horizontal portions. Other configurations for slide blocks 38 can also be utilized within the scope of the invention so long as means are provided for preventing beverage support members 26, 28 from slidably disengaging when expanded.

While this invention has been described in relation to its preferred embodiments, it is to be understood that various modifications thereof will be apparent to those or ordinary skill in the art upon reading the specification together with the accompanying drawings, and it is intended to cover all such modifications as fall within the scope of the appended claims.

What is claimed is:

1. Collapsible pensile food carrier comprising substantially rigid beverage support means, foldable auxiliary receptacle means and foldable strap means for suspending said auxiliary receptacle means from said beverage support means, said beverage support means further comprising two substantially rigid, slidably engaged beverage support members, each of which is adapted by means of at least one aperture disposed therethrough to receive and maintain at least one beverage cup in a substantially upright position.

2. Collapsible pensile food carrier comprising substantially rigid beverage support means, foldable auxiliary receptacle means and foldable strap means for suspending said auxiliary receptacle means from said beverage support means, said beverage support means further comprising two substantially rigid, slidably engaged beverage support members, each of which is adapted by means of at least one aperture disposed therethrough to receive and maintain at least one beverage cup in a substantially upright position, said beverage support members being further adapted so as to prevent them from slidably disengaging when fully expanded.

3. Collapsible pensile food carrier comprising substantially rigid beverage support means, foldable auxiliary receptacle means and foldable strap means for suspending said auxiliary receptacle means from said beverage support means, said beverage support means further comprising two substantially rigid, slidably engaged beverage support members, each of which is adapted by means of at least one aperture disposed therethrough to receive and maintain at least one beverage cup in a substantially upright position, said beverage support members being further adapted so as to prevent them from slidably disengaging when fully expanded, and being further adapted to be reversibly locked in fixed relation to each iother when fully expanded.

4. A kit comprising collapsible pensile food carrier means and means for storing and transporting said pensile food carrier means while in its collapsed position, wherein said collapsible pensile food carrier means further comprises beverage support means and a foldable auxiliary receptacle means, said beverage support means further comprising a plurality of slidably engaged beverage support members, each of which is adapted to receive and maintain at least one drinking cup in a substantially upright position when said collapsible pensile food carrier means is expanded into its operational position and supported in the hands of the user, said foldable auxiliary receptacle means being suspended from said beverage support means when said pensile food carrier means is expanded to its operational position and being adapted to be folded around said beverage support means when said pensile food carrier is collapsed for storage or transport.

* * * * *

UNITED STATES PATENT AND TRADEMARK OFFICE

CERTIFICATE OF CORRECTION

PATENT NO. : 4,489,971

DATED : December 25, 1984

INVENTOR(S) : Alfonso E. Martinez, Sr.

It is certified that error appears in the above-identified patent and that said Letters Patent is hereby corrected as shown below:

In Column 1, line 43, change "pipcorn" to -- popcorn --; and in Column 8, line 1, change "iother" to -- other --.

Signed and Sealed this

*Sixteenth* Day of *April 1985*

[SEAL]

*Attest:*

DONALD J. QUIGG

*Attesting Officer*

*Acting Commissioner of Patents and Trademarks*